US012736273B2

(12) United States Patent
Burns et al.

(10) Patent No.: US 12,736,273 B2
(45) **Date of Patent: *Sep. 15, 2026**

(54) TRIM BREAKER PROFILE FOR A VACUUM INSULATED STRUCTURE

(71) Applicant: WHIRLPOOL CORPORATION, Benton Harbor, MI (US)

(72) Inventors: John Joseph Burns, St. Joseph, MI (US); Amalia Katherine Hornung, St. Joseph, MI (US); Vishal Jaywantrao Patil, Pune (IN); Jackson Felipe Karl, Stevensville, MI (US); Rishikesh Vinayak Kulkarni, St. Joseph, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 116 days.

This patent is subject to a terminal disclaimer.

(21) Appl. No.: 18/654,526

(22) Filed: May 3, 2024

(65) Prior Publication Data

US 2025/0341359 A1 Nov. 6, 2025

(51) Int. Cl.

| | |
|---|---|
| ***F25D 23/02*** | (2006.01) |
| ***F25D 23/04*** | (2006.01) |
| ***F25D 23/06*** | (2006.01) |
| ***F25D 23/08*** | (2006.01) |

(52) U.S. Cl.

CPC ..... *F25D 23/02* (2013.01); *F25D 23/028* (2013.01); *F25D 23/04* (2013.01); *F25D 23/062* (2013.01); *F25D 23/085* (2013.01); *F25D 23/087* (2013.01); *F25D 23/061* (2013.01); *F25D 23/066* (2013.01); *F25D 2201/14* (2013.01)

(58) Field of Classification Search

CPC ..... F25D 23/02; F25D 23/028; F25D 23/04; F25D 2201/04; F25D 23/061

See application file for complete search history.

(56) References Cited

U.S. PATENT DOCUMENTS

| | | | |
|---|---|---|---|
| 3,359,053 | A | 12/1967 | Hagendoorn |
| 4,469,383 | A | 9/1984 | Losert |
| 4,653,819 | A | 3/1987 | Swerbinsky |
| 4,916,864 | A | 4/1990 | Thompson |
| 6,266,970 | B1 | 7/2001 | Nam et al. |
| 7,147,292 | B2 | 12/2006 | Lee et al. |

(Continued)

FOREIGN PATENT DOCUMENTS

| | | | |
|---|---|---|---|
| GB | 725546 | A | 3/1955 |
| GB | 729393 | A | 5/1955 |
| JP | 3871500 | B2 | 1/2007 |

*Primary Examiner* — Kimberley S Wright

(74) *Attorney, Agent, or Firm* — PRICE HENEVELD LLP

(57) ABSTRACT

A refrigeration appliance includes a cabinet defining a compartment. A door assembly is operably coupled to the cabinet and operable between an opened position and a closed position. The door assembly includes an inner liner and an outer wrapper spaced apart from the inner liner to define a cavity. A trim breaker extends around a perimeter of the door assembly. The inner liner and outer wrapper are coupled to the trim breaker to close the cavity. A projection is defined by the trim breaker and extends toward the compartment when the door assembly is in a closed position. A cover is operably coupled to the trim breaker and the inner liner of the door. The cover is positioned over the projection of the trim breaker.

20 Claims, 8 Drawing Sheets

(56) References Cited

U.S. PATENT DOCUMENTS

| | | | | |
|---|---|---|---|---|
| 8,083,305 | B2 | 12/2011 | Lee et al. | |
| 9,863,690 | B1 * | 1/2018 | Demiroez | F25D 23/04 |
| 9,879,900 | B1 * | 1/2018 | Ammerman | F25D 23/04 |
| 10,563,905 | B1 * | 2/2020 | Allard | F25D 23/085 |
| 11,313,611 | B2 | 4/2022 | Allard et al. | |
| 11,320,193 | B2 | 5/2022 | Visin et al. | |
| 11,624,547 | B2 | 4/2023 | Kulkarni et al. | |
| 11,859,895 | B2 | 1/2024 | Chhajed et al. | |
| 2005/0242529 | A1 | 11/2005 | Kim et al. | |
| 2009/0007587 | A1 | 1/2009 | Lanzl et al. | |
| 2014/0103791 | A1 | 4/2014 | Cheon | |
| 2019/0128591 | A1 | 5/2019 | Visin et al. | |
| 2020/0088455 | A1 * | 3/2020 | Toyooka | F25D 23/028 |
| 2021/0102741 | A1 | 4/2021 | Kang et al. | |
| 2021/0348831 | A1 * | 11/2021 | Kapure | F25D 23/082 |
| 2022/0252333 | A1 | 8/2022 | Awachat et al. | |
| 2023/0078837 | A1 | 3/2023 | Ekshinge et al. | |
| 2023/0251026 | A1 * | 8/2023 | Chhajed | F25D 23/087<br>312/406 |
| 2023/0258389 | A1 * | 8/2023 | Choy | F25D 23/04<br>312/405.1 |

* cited by examiner

TRIM BREAKER PROFILE FOR A VACUUM INSULATED STRUCTURE

BACKGROUND OF THE DISCLOSURE

The present disclosure generally relates to a trim breaker profile, and more specifically, to a trim breaker profile for a vacuum insulated structure.

SUMMARY OF THE DISCLOSURE

According to one aspect of the present disclosure, a vacuum insulated appliance includes a cabinet that defines a compartment. A vacuum insulated door is operably coupled with the cabinet, where the vacuum insulated door is operable between an opened position and a closed position. The vacuum insulated door includes an inner liner proximate the compartment when the vacuum insulated door is in the closed position. An outer wrapper is opposite the inner liner. A trim breaker is operably coupled to the inner liner and the outer wrapper to define a door cavity, where the trim breaker defines a projection extending toward the compartment when the vacuum insulated door is in the closed position. A gasket is coupled to the trim breaker and extends along a perimeter of the trim breaker, where the gasket abuts the cabinet when the vacuum insulated door is in the closed position. A cover is operably coupled to the vacuum insulated door and extends along a perimeter of the vacuum insulated door, where the cover is positioned over the projection.

According to another aspect of the present disclosure, a refrigeration appliance includes a cabinet defining a compartment. A door assembly is operably coupled to the cabinet and is operable between an open position and a closed position. The door assembly includes an inner liner and an outer wrapper spaced apart from the inner liner to define a cavity. A trim breaker extends around a perimeter of the door assembly. The inner liner and outer wrapper are coupled to the trim breaker to close the cavity. A projection defined by the trim breaker and extending toward the compartment when the door assembly is in a closed position. A cover is operably coupled to the trim breaker and the inner liner of the door, where the cover is positioned over the projection of the trim breaker.

According to yet another aspect of the present disclosure, an appliance includes a cabinet defining a compartment. A door assembly is operably coupled with the cabinet. The door assembly includes an inner liner and an outer wrapper opposite the inner liner. The inner liner and the outer wrapper define a vacuum insulated door cavity. A trim breaker is operably coupled to the inner liner and the outer wrapper, where the trim breaker defines a projection having a first wall and a second wall and extending outward from the inner liner and around a perimeter of the trim breaker. A cover is operably coupled to the trim breaker and the inner liner. The cover extends around the perimeter of the trim breaker, where the cover is positioned over the projection.

These and other features, advantages, and objects of the present disclosure will be further understood and appreciated by those skilled in the art by reference to the following specification, claims, and appended drawings.

Figure 1:
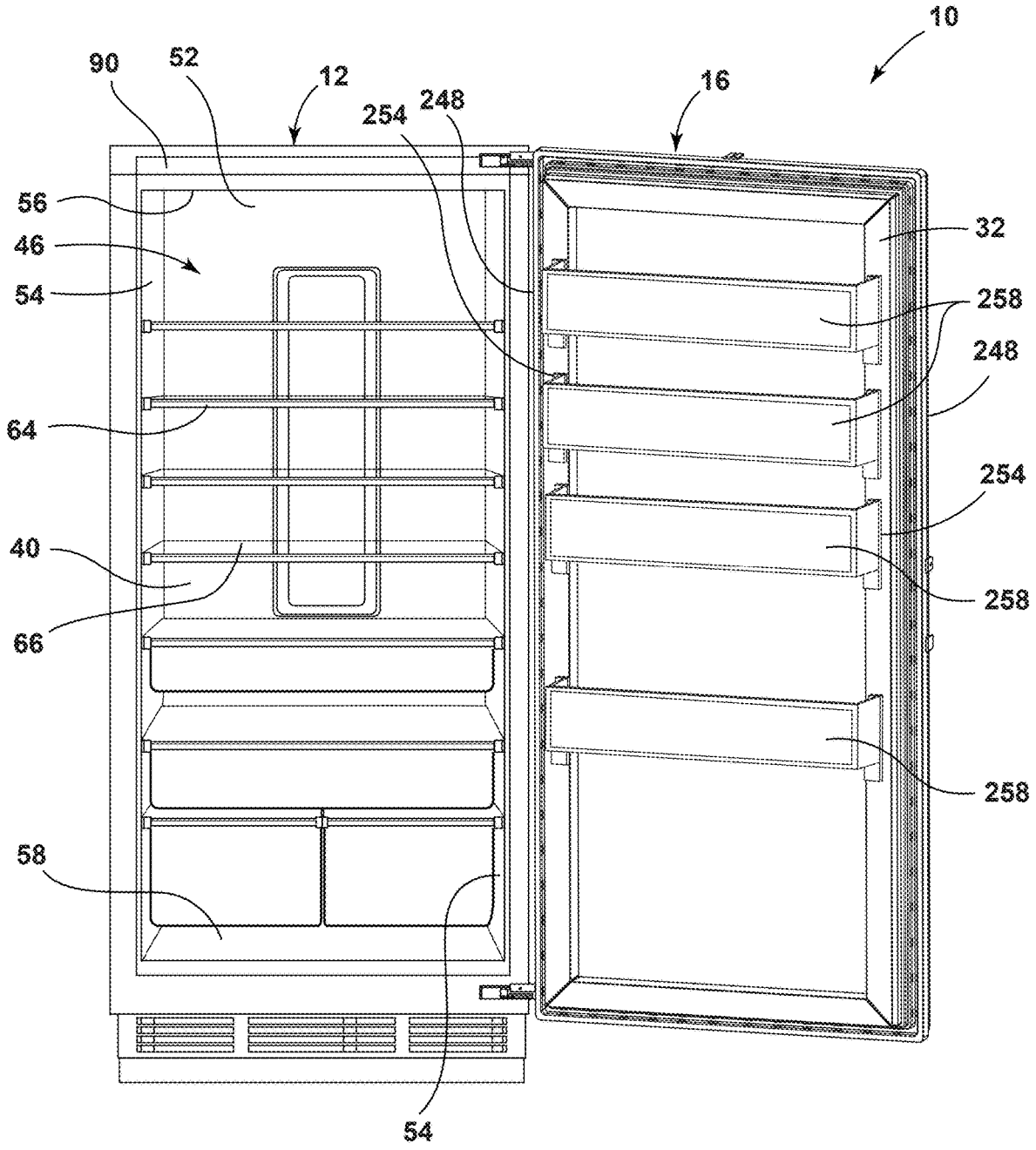
FIG. 1 is a front perspective view of a vacuum insulated appliance with an insulated door and a cabinet, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a trim breaker profile for a vacuum insulated structure. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Figure 2:
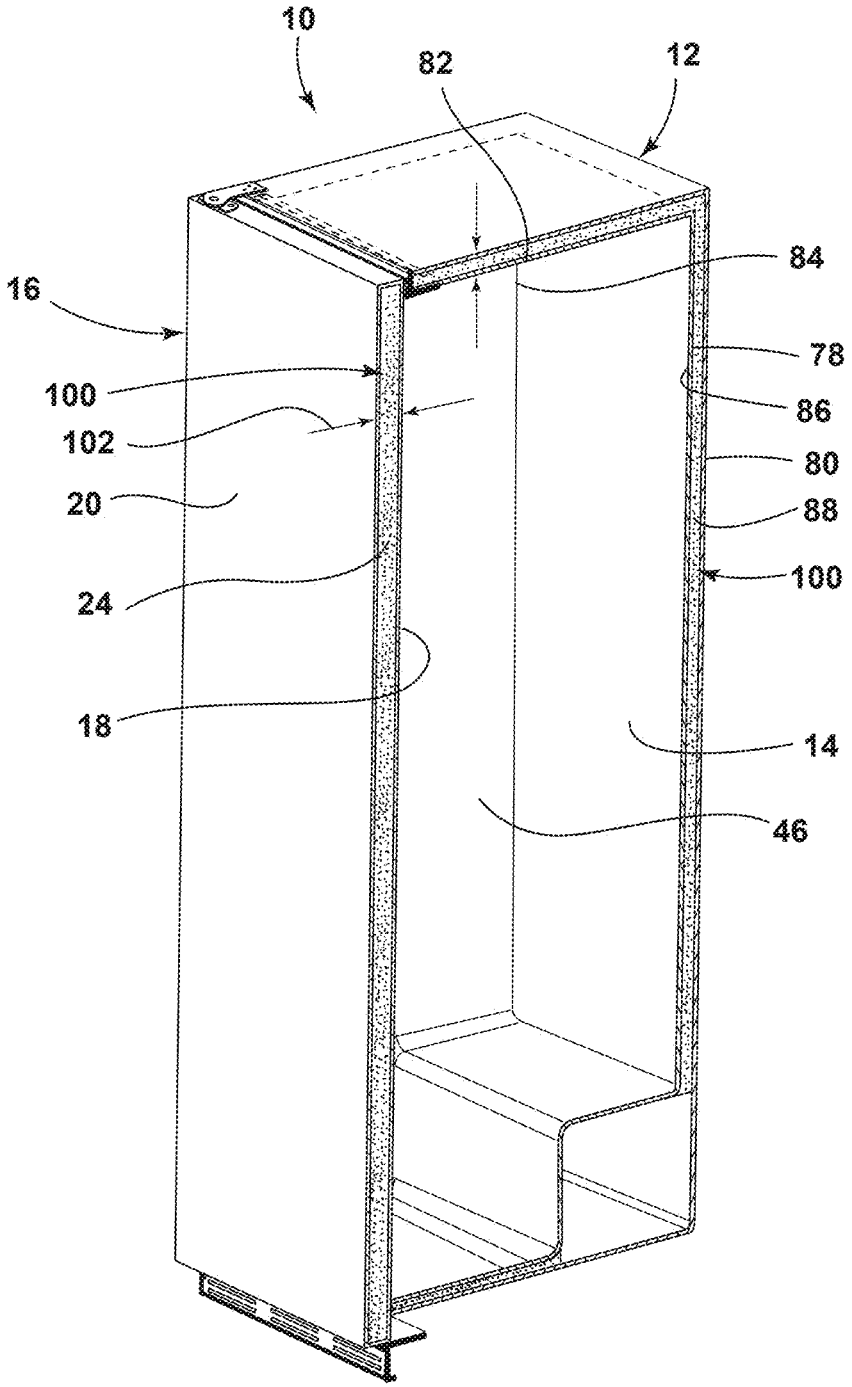
FIG. 2 is a side perspective cross-sectional view of a vacuum insulated appliance with an insulated door in a closed position, according to the present disclosure.

Referring to FIGS. 1-8, reference numeral 10 generally designates an appliance that may be at least partially vacuum insulated. The vacuum insulated appliance 10 includes a cabinet 12 defining a compartment 14 and a door 16 operably coupled with the cabinet 12. One or both of the cabinet 12 and the door 16 may be vacuum insulated. The door 16 is operable between an opened position (FIG. 1) and a closed position (FIG. 2). The door 16 includes an inner liner 18 proximate the compartment 14 when the door 16 is in the closed position, and an outer wrapper 20 opposite the inner liner 18. A trim breaker 22 is operably coupled to the inner liner 18 and the outer wrapper 20 to at least partially define a door cavity 24. The trim breaker 22 defines a projection 26 extending toward the compartment 14 when the door 16 is in the closed position. A gasket 28 is coupled to the trim breaker 22 and extends along a perimeter of the trim breaker. The gasket 28 abuts the cabinet 12 when the door 16 is in the closed position. A cover 32 is operably coupled to the door 16 and extends along a perimeter of the door 16, and the cover 32 is positioned over the projection 26.

Referring to FIGS. 1 and 2, the appliance 10 is illustrated as a refrigerating appliance, however, it is contemplated that the insulated door 16 disclosed herein may be used with a variety of appliances, structures, or insulation purposes other than with an appliance 10. Moreover, the illustrated refrigerating appliance 10 is a full, single-door refrigerator having the vacuum insulated door 16. The vacuum insulated door 16 may be a rotationally and/or laterally operable panel for doors 16 and drawers. In non-limiting examples, the refrigerating appliance 10 can be a bottom mount refrigerator, a bottom mount French door refrigerator, a top mount refrigerator, a side-by-side refrigerator, a four-door French door refrigerator, and/or a five-door French door refrigerator, each of which can have one or more insulated doors 16 (e.g., panels). In other non-limiting examples, the vacuum-insulated appliance 10 can also be a freezer, such as a top-freezer, a bottom-freezer, a side-by-side freezer, a French door freezer, a triple door freezer, an integrated/built-in freezer, and a chest freezer.

Referring still to FIGS. 1 and 2, the refrigeration appliance 10 includes the cabinet 12 and the door 16. The cabinet 12 includes the compartment 14 and defines an opening 40 into the compartment 14. The compartment 14 is configured to hold and store food items. The door 16 is operably coupled to the cabinet 12 via hinges, welding, or other forms of fasteners. The door 16 is movable to, from, and between the closed position and the opened position. In the opened position, as is illustrated in FIG. 1, the door 16 allows access through the opening 40 to an internal environment of the compartment 14. In the closed position, as is illustrated in FIG. 2, the door 16 generally denies access through the opening 40 and into the compartment 14, thereby sealing the compartment 14.

The cabinet 12 includes interior surfaces 46 that define the compartment 14. For example, as illustrated in FIG. 1, the interior surfaces 46 can be those provided by a rear wall 52, side walls 54, a ceiling 56, and a floor 58 that collectively define the compartment 14. The ceiling 56 and the floor 58 oppose each other, and the side walls 54 oppose each other. The rear wall 52 and the door 16 oppose each other when the door 16 is in the closed position. Further, the compartment 14 can include one or more shelves 64, and other forms of storage that provide a support surface 66 upon which the food items can be placed. The compartment 14 may also include one or more bins or drawers.

The cabinet 12 also includes a conduit 72 (FIG. 4) that may be referred to as a heat loop, a Yoder loop, or a condenser loop, but is not meant to be limited to any one shape or configuration by the term "loop." A medium, such as a refrigerant, may be circulated through the conduit 72. In various aspects, mechanical equipment generally positioned within a machine compartment of the appliance 10 may be operably coupled with the conduit 72 to form a refrigerant circuit. The refrigerant may be directed through the equipment where the refrigerant is converted from a liquid to a gas, thereby absorbing heat as a result of this reaction. As the heated refrigerant travels through the conduit 72, the refrigerant can release heat, which can reduce moisture and frost buildup. Accordingly, the refrigerant contained and transported through the conduit 72 may provide for a conduction path that creates an "anti-sweat" feature to help reduce or prevent condensation that can develop when the cold surfaces of the compartment 14 are exposed to ambient air in which the appliance 10 is disposed. This warm and humid ambient air can cause condensation to develop along various components of the appliance 10.

Referring still to FIGS. 1 and 2, the cabinet 12 includes or is a vacuum insulated structure. The cabinet 12 can include an inner cabinet liner 78 and an outer cabinet wrapper 80. The outer cabinet wrapper 80 at least partially envelops the inner cabinet liner 78. The inner cabinet liner 78 generally forms the compartment 14 with a top section 82 forming the ceiling 56 of the compartment 14, a rear section 84 forming the rear wall 52 of the compartment 14, and opposing side sections 86 forming the opposing side walls 54 of the compartment 14, respectively. Additionally, the outer cabinet wrapper 80 and the inner cabinet liner 78 generally define an insulating cabinet cavity 88 therebetween. The cabinet 12 may also include a cabinet trim breaker that couples the inner cabinet liner 78 and the outer cabinet wrapper 80 together, as well as seal the insulating cabinet cavity 88. The cabinet 12 can include a forward surface 90, and the door 16 can engage the forward surface 90 to form a seal around the compartment 14 when the door 16 is in the closed position.

The door cavity 24 of the door 16 and the insulating cabinet cavity 88 of the cabinet 12 typically includes one or more insulation materials 100 disposed therein. It is generally contemplated that the insulation materials 100 may be glass-type materials, carbon-based powders, silicon oxide-based materials, silica-based materials, insulating gases, and other standard insulation materials 100 known in the art. The insulation materials 100 substantially fill the insulating door cavity 24 forming a substantially continuous layer between the outer wrapper 20 and the inner liner 18 of the door 16. Similarly, the insulation materials 100 substantially fill the insulation cabinet cavity 98 forming a substantially continuous layer between the outer cabinet wrapper 80 and the inner cabinet liner 78. The insulation materials 100 are disposed in each of the insulating cavities 24, 88. The outer wrappers 20, 80 and the inner liners 18, 78 may be made from a material at least partially resistant to bending, deformation, or otherwise being formed in response to an inward compressive force. These materials for the inner liner 18 and the outer wrapper 20 for the door 16 and the inner cabinet liner 78 and the outer cabinet wrapper 80 of the cabinet 12 include, but are not limited to, metals, polymers, metal alloys, combinations thereof, and/or other similar substantially rigid materials that can be used for vacuum insulated appliances 10.

An at least partial vacuum is defined within the insulating door cavity 24. The at least partial vacuum defines a pressure differential 102 between an exterior of the insulated door 16 and the insulating door cavity 24. The pressure differential 102 serves to define the inward compressive force that is exerted on both the outer wrapper 20 and the inner liner 18 and tends to bias the outer wrapper 20 and the inner liner 18 toward the insulating door cavity 24. Over time, gas can infiltrate into the insulating door cavity 24 from an area outside the appliance 10 which can diminish the at least partial vacuum. The infiltration of gas is sometimes referred to as gas permeation, which can result in the at least partial vacuum to decrease over time.

The outer wrapper 20 of the door 16 defines an evacuation port, which is an opening into the insulating door cavity 24. The at least partial vacuum is typically defined by evacuation of the door cavity 24 through the evacuation port. A vacuum device and evacuation port assembly can be positioned around the evacuation port to draw the at least partial vacuum through the evacuation port. Once the desired pressure differential 102 is defined between the external environment and the insulating door cavity 24 the evacuation port is sealed to form the insulated door 16. Similar vacuum insulation technology and processes can be utilized in order to vacuum insulate the cabinet 12 structure. It is contemplated, however, that one or both the door 16 and cabinet 12 of the appliance 10 may not be vacuum insulated.

Figure 3:
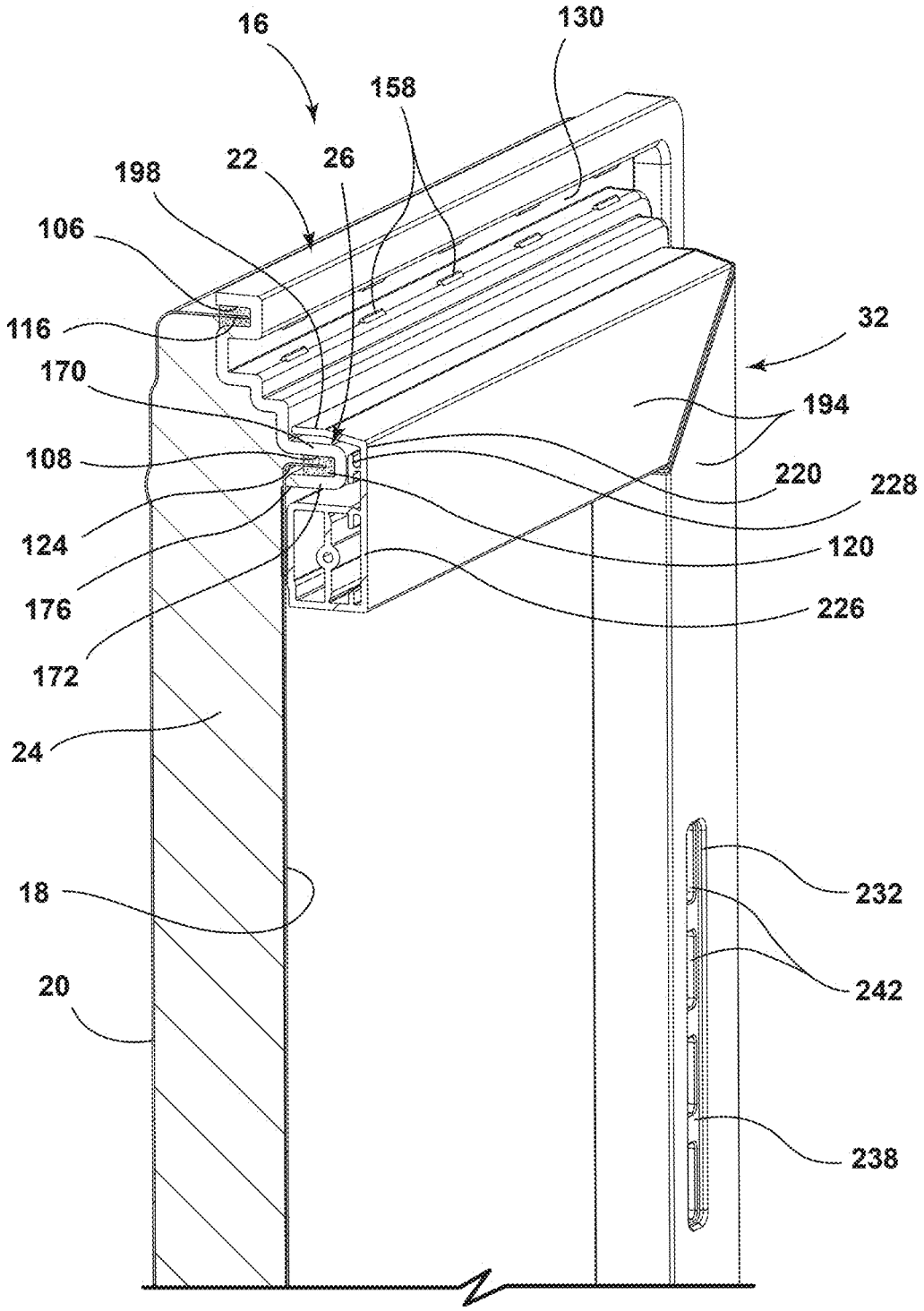
FIG. 3 is a partial cross-sectional, side perspective view of a vacuum insulated door having a trim breaker and a cover defining an elongate opening, according to the present disclosure.
Figure 4:
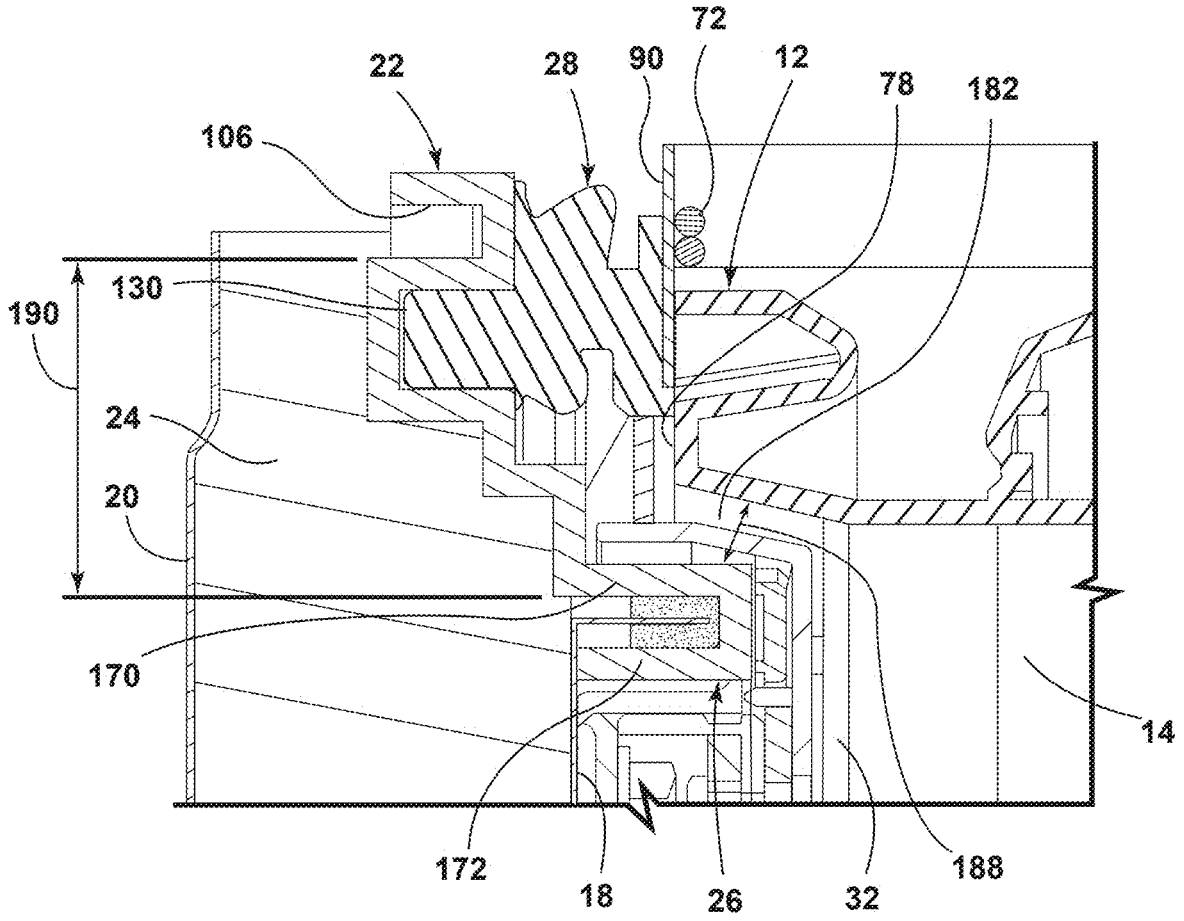
FIG. 4 is a cross-sectional view of a gap defined between a cover on a door and an interior surface of a cabinet of a vacuum insulated appliance, according to the present disclosure.
Figure 5:
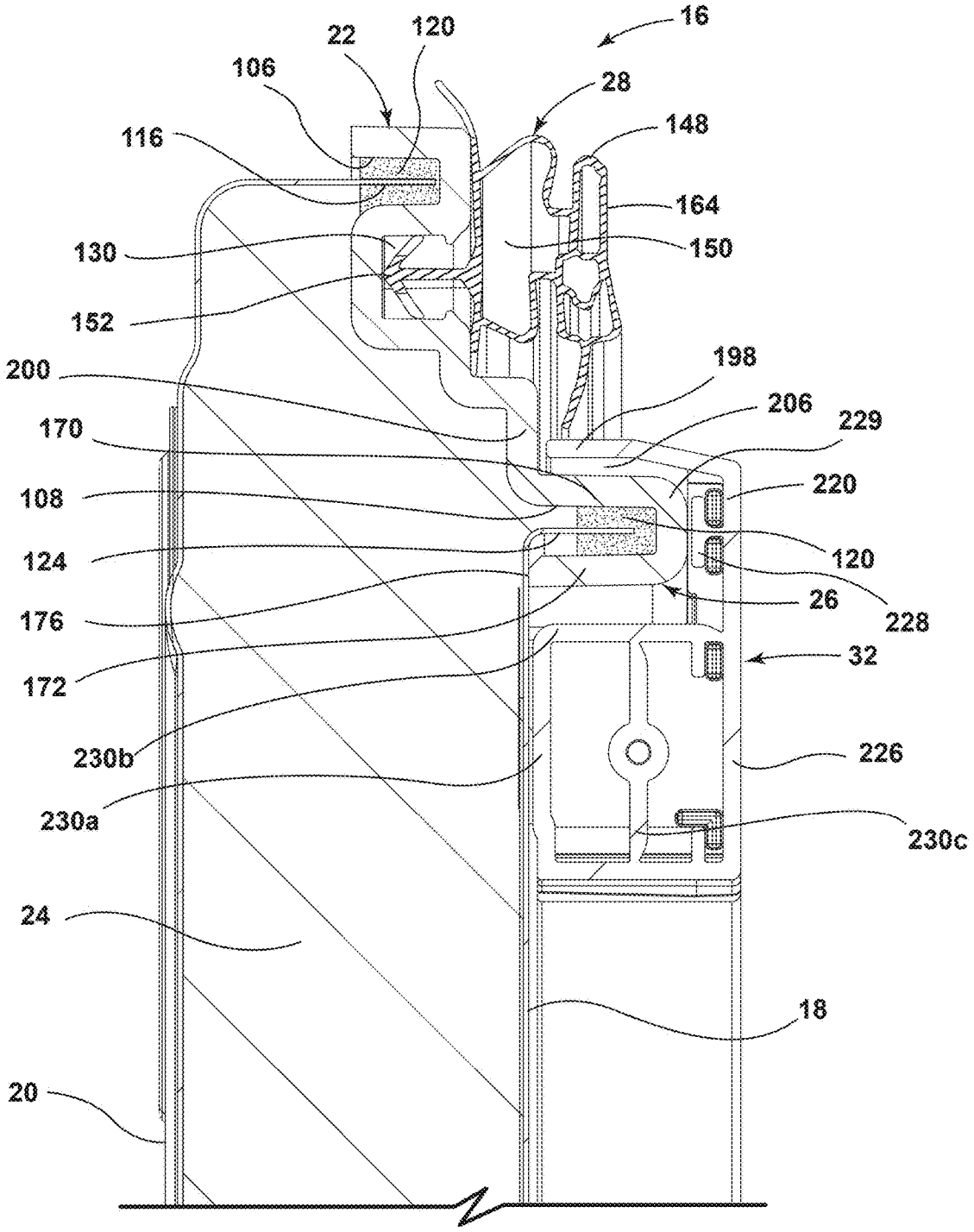
FIG. 5 is a partial cross-sectional view of a vacuum insulated door having a gasket coupled to a trim breaker, according to the present disclosure.

Referring now to FIGS. 3-5, the insulated door 16 also includes the trim breaker 22 configured to assist in maintaining insulative properties (e.g., the vacuum) of the insulated door 16, as well as affecting airflow between the door 16 and the cabinet 12. The trim breaker 22 is generally coupled to the inner liner 18 and the outer wrapper 20 of the door 16. For example, the trim breaker 22 of the door 16 includes a first groove 106 and a second groove 108, where the second groove 108 can be defined by the projection 26. The first groove 106 is disposed closer to an outer perimeter of the trim breaker 22 than the second groove 108. Generally, the first groove 106 and the second groove 108 are offset from one another. Additionally, both the first groove 106 and the second groove 108 are oriented in a same direction, where an opening into each groove 106, 108 is oriented away from the cabinet 12 when the door 16 is closed.

An edge 116 of the outer wrapper 20 of the door 16 is disposed within the first groove 106 of the trim breaker 22 to couple the trim breaker 22 and the outer wrapper 20 together. Adhesive 120 can be disposed within the first groove 106, surrounding the edge 116 of the outer wrapper 20 to provide an air-tight seal. An edge 124 of the inner liner 18 of the door 16 is disposed within the second groove 108 of the trim breaker 22 to couple the trim breaker 22 and the inner liner 18 together. Similarly, adhesive 120 can be disposed within the second groove 108, surrounding the edge 124 of the inner liner 18 to provide an air-tight seal. Accordingly, the trim breaker 22 can be a single, continuous piece that extends around the perimeter of the door 16. This configuration can allow the trim breaker 22 to provide a generally seamless or continuous seal and barrier along the outer perimeter of the door 16 for coupling the inner liner 18 and the outer wrapper 20 and sealing the door cavity 24. The trim breaker 22 may be made from a material at least partially resistant to bending, deformation, temperature changes, and weathering. These materials for the trim breaker 22 include, but are not limited to, thermoplastic and thermoset polymers, aluminum or other metal alloys, fiber-reinforced composites, and other similar materials.

The trim breaker 22 of the door 16 can also include a gasket channel 130 configured to receive the gasket 28, as further described herein. The gasket channel 130 is open from a direction opposite the first and second groove 106, 108. In this way, the inner liner 18 and the outer wrapper 20 are coupled to a first, generally outer side of the trim breaker 22, and the gasket 28 is coupled to a second, generally inner side of the trim breaker 22. The gasket channel 130 is generally disposed between the first groove 106 and the second groove 108 with the first groove 106 being closest to an outer perimeter of the trim breaker 22.

Figure 6:
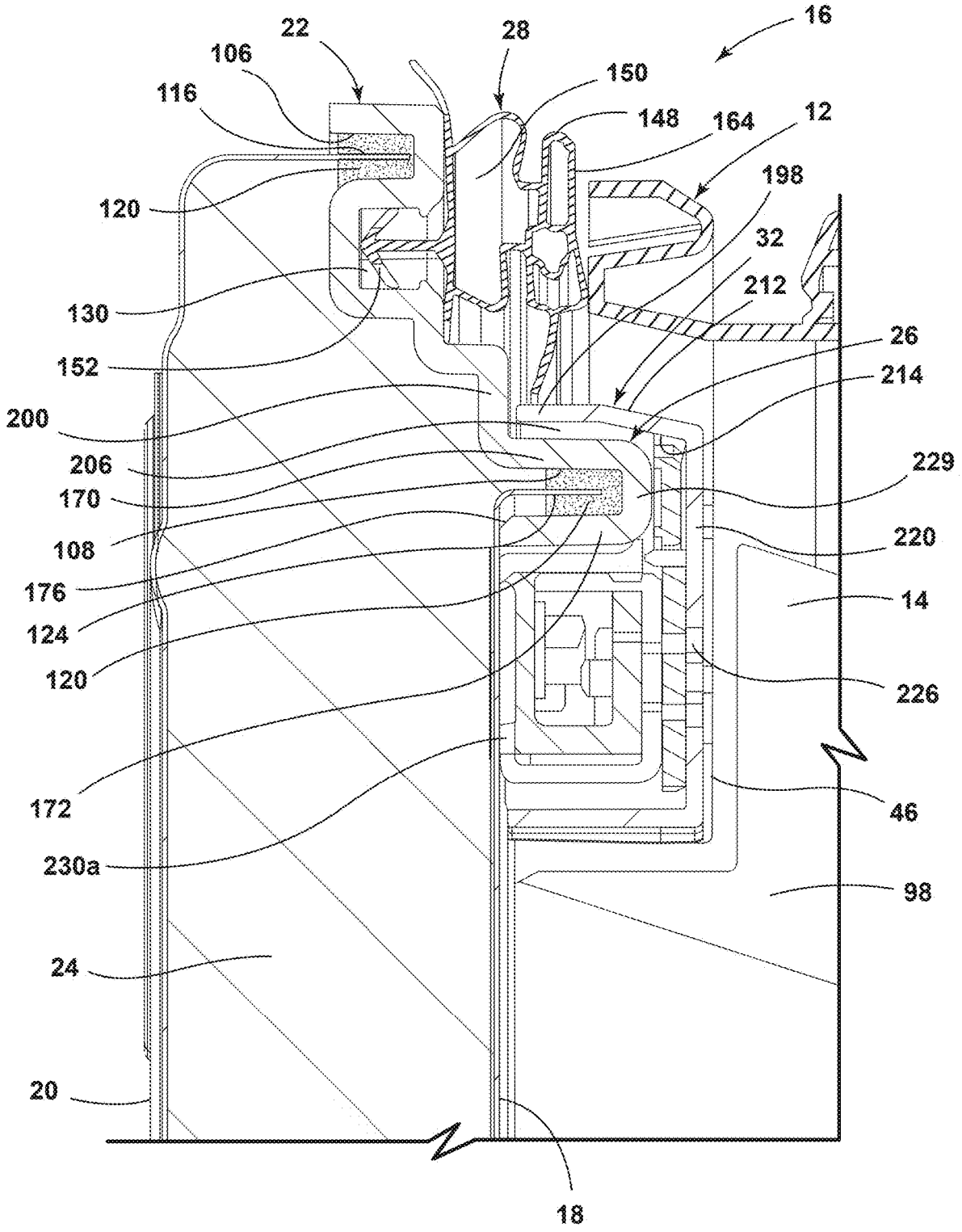
FIG. 6 is a partial cross-sectional view of a vacuum insulated door engaging with a cabinet of a vacuum insulated appliance, according to the present disclosure.

Referring to FIGS. 4-6, the door 16 further includes the gasket 28 operably coupled to the trim breaker 22 and configured to form a seal against the cabinet 12 when the door 16 is in the closed position. For example, the cabinet 12 includes the forward surface 90, and the gasket 28 is configured to abut the forward surface 90 to form the seal against the forward surface 90. The gasket 28 can include an engagement portion 148, a central portion 150, and a gasket anchor 152. The engagement portion 148 is configured to compress against the cabinet 12 to form the seal. In certain aspects, the engagement portion 148 may include a magnet for retaining the engagement with the cabinet 12.

The central portion 150 is disposed between the engagement portion 148 and the gasket anchor 152 and provides flexibility to the gasket 28, allowing the gasket 28 to conform to variations on the forward surface 90 of the cabinet 12 and maintain a more reliable and/or airtight seal. The gasket 28 is configured to be positioned within the gasket channel 130 of the trim breaker 22 and retained in the gasket channel 130 by an engagement between the trim breaker 22 and the gasket anchor 152. The anchoring in the trim breaker 22 can help ensure a tighter and more consistent seal between the door 16 and the cabinet 12 when the door 16 is in the closed position. Specifically, the gasket channel 130 of the trim breaker 22 includes tabs 158 (FIGS. 3 and 7) along a length of the gasket channel 130 that assist in providing a barrier for the gasket anchor 152 for holding the gasket anchor 152 in the gasket channel 130. The gasket anchor 152 may be inserted within the gasket channel 130 and may interlock or engage with the tabs 158, securing the gasket 28 in place within the gasket channel 130 of the trim breaker 22. It is contemplated that the gasket 28 may be coupled to the trim breaker 22 through other configurations, such as adhesive, snap-fit, fasteners, notches, or other similar mechanisms.

Once the gasket 28 is positioned within the gasket channel 130 of the trim breaker 22, the engagement portion 148 can provide an engagement surface 164 that is positioned to interface with, and form the seal against, the forward surface 90 of the cabinet 12 (e.g., the outer cabinet wrapper 80 or cabinet trim breaker) when the door 16 is in the closed position. In configurations with the magnet, the magnet can draw the gasket 28 and, by proximity, draws the door 16 toward the forward surface 90 of the cabinet 12 to seal the door 16 to the cabinet 12. The gasket 28 can be made of materials including, but not limited to, rubber compounds, thermoplastic elastomers, as well as foam and/or hybrid materials.

Referring still to FIGS. 4-6, the second groove 108 of the trim breaker 22 of the door 16 is defined by the projection 26. The projection 26 of the trim breaker 22 includes a first wall 170 and a second wall 172, where the first wall 170 is opposite the second wall 172 with the second groove 108 defined therebetween. An edge 176 of the second wall 172 of the projection 26 may abut the inner liner 18 of the door 16 to assist in the coupling of the trim breaker 22 to the inner liner 18, and further, to assist in closing the insulating door cavity 24.

When the door 16 is in the closed position, the projection 26 extends toward and/or into the compartment 14. In some implementations, the projection 26 may oppose one or more of the interior surfaces 46 of the cabinet 12 that defines the compartment 14. Generally, the projection 26 is spaced from the interior surfaces 46, however the projection 26 may make direct contact with the cabinet 12 when the door 16 is in the closed position without departing from the teachings herein. In implementations where the projection 26 is spaced from the interior surfaces 46, a gap 182 is defined between the projection 26 and the interior surfaces 46 of the cabinet 12.

The projection 26 generally extends along an entire perimeter of the door 16, such that the projection 26 forms a rectangular or square configuration, mirroring the opening 40 into the compartment 14. In such examples, the projection 26 may be spaced from the various interior surfaces 46 that form the compartment 14. Additionally, the projection 26 can be elongated to extend at least to, or farther than, an engagement point between the gasket 28 and the cabinet 12 to reduce a width of the gap 182 around a substantial portion, or an entirety, of a perimeter of the opening 40, as is further described herein.

Referring to the illustrated configuration depicted in FIGS. 4 and 6, the gap 182 separating the projection 26 of the trim breaker 22 of the door 16 from the compartment 14 has a shortest distance 188 between the first wall 170 of the projection 26 and the respective interior surface 46 of the cabinet 12 defining the compartment 14 when the door 16 is in the closed position. This shortest distance 188 may be defined between the projection 26 and each of the ceiling 56, the floor 58, and the side walls 54 of the cabinet 12. In some implementations, the shortest distance 188 may be less than about 6.2 mm, however the shortest distance 188 may be within a range of approximately 2 mm to approximately 13 mm. In other implementations, the shortest distance 188 may be approximately zero, for example, when the projection 26 contacts the interior surface 46 of the cabinet 12 defining the compartment 14.

Additionally, the shortest distance 188 between the first wall 170 of the projection 26 and the respective interior surface 46 of the cabinet 12 may correlate with a height 190 defined between the conduit 72 and the projection 26 when the door 16 is in the closed position. The height 190 may be about 13 mm, however, the height 190 may be within a range of approximately 10 mm to approximately 31 mm. The height 190 may be advantageous for reducing heat conduction from the conduit 72 to the trim breaker 22 to reduce or minimize an impact on heat gain and energy consumption by the appliance 10. Accordingly, the configuration of the projection 26 may allow the projection 26 to be spaced farther from the conduit 72 to reduce heat conduction and extend farther into the compartment 14 to reduce or minimize cold airflow to lesser insulated regions of the gasket 28 and, consequently, reduce or minimize condensation on the gasket 28 and improve energy consumption.

In more conventional arrangements, a spacing between the door structure and the cabinet structure is greater than the shortest distance 188 disclosed herein, which can allow cold airflow to pass over the gasket 28 of the door 16 creating or contributing to condensation buildup along the gasket 28. Further, more conventional arrangements allowing cold airflow to the gasket 28 can weaken insulative capabilities of the appliance. Similarly, more conventional arrangements can allow increased thermal transfer from the heat loop to the door structure, which can increase the heat load of the appliance on the door structure further impacting the insulative capabilities of the appliance.

The configuration of the trim breaker 22 of the door 16 of the present disclosure assists in reducing the heat and airflow transfer across the interface and through the gap 182. Particularly, the increased height 190 can maximize the space between the trim breaker 22 and the conduit 72 to reduce heat transfer. Further, the gap 182 can reduce airflow transfer across an interface defined between the door 16 and the cabinet 12 because the projection 26 of the trim breaker 22 of the door 16 extends into the compartment 14, which can increase energy efficiency. In this regard, the elongation of the projection 26 extending toward/into the compartment 14 assists in minimizing the width of the gap 182 to, consequently, minimize condensation and impact on heat gain and energy consumption.

Referring now to FIGS. 3-7, the cover 32 is operably coupled to the door 16 to assist in further reducing the width of the gap 182. The cover 32 may include a plurality of cover sections 194. For example, the cover 32 may include four separate cover sections that form the cover 32 that extend along respective edges of the door 16, or, alternatively, the cover 32 may be a singular, integral piece that extends along the perimeter of the door 16. The cover 32 may be coupled to the door 16 via an adhesive, fastener, snap-fit, or other similar coupling mechanism. Moreover, the cover sections 194 may be coupled to one another in a similar manner.

As illustrated in FIGS. 5 and 6, a first portion 198 of the cover 32 extends from a ledge 200 of the trim breaker 22 between the gasket channel 130 and the first wall 170 of the projection 26 of the door 16. Accordingly, the first portion 198 of the cover 32 is proximate to the gasket 28 and extends along, or adjacent to, the first wall 170 of the trim breaker 22 defining a space 206 therebetween. The first portion 198 of the cover 32 includes an outer surface 212 and an inner surface 214. The outer surface 212 of the cover 32 is positioned proximate the gasket 28 and at least partially defines the gap 182 between the outer surface 212 of the first portion 198 of the cover 32 and the interior surface 46 of the cabinet 12 when the door 16 is in the closed position. The inner surface 214 of the cover 32 defines the space 206 between the first wall 170 of the projection 26 and the first portion 198 of the cover 32. Accordingly, along with the projection 26 of the trim breaker 22, the cover 32 assists in minimizing the width of the gap 182 by further decreasing the shortest distance 188 of the gap 182.

A second portion 220 of the cover 32 extends over or along the projection 26 from the first portion 198 toward a center of the door 16 to cover the projection 26. The second portion 220 can extend generally parallel to the inner liner 18 and adjacent to the projection 26. A third portion 226 of the cover 32 extends generally perpendicular from the second portion 220 and engages or is disposed adjacent to the inner liner 18 of the door 16, extending generally parallel to the second wall 172 of the projection 26 and aligning with the edge 176 of the second surface 172 of the projection 26. Accordingly, when the door 16 is in the closed position, the projection 26 of the trim breaker 22 and the cover 32 extend towards and/or into the compartment 14 of the cabinet 12.

In various aspects, the second portion 220 of the cover 32 includes an internal projection 228 that engages an end 229 of the projection 26 between the first and second walls 170, 172. This engagement can help securely lock or train the cover 32 in place to prevent or reduce shifting or dislodging of the trim breaker 22 from the door 16. Additionally, the cover 32 can include one or more internal walls 230*a*-230*c*. In various aspects, the internal wall 230*a* runs along the inner liner 18 of the door 16 parallel to the second portion 220. The internal projection 228 of the second portion 220 and the internal wall 230 can help the cover 32 maintain an overall rigid composition (e.g., increase rigidity of the cover 32) and help to properly place and secure engagement of the cover 32 with both the trim breaker 22 and the door 16. The internal wall 230*b* may extend between the internal wall 230*a* and the second portion 220, and the internal wall 230*c* may extend between the internal wall 230*b* and the third portion 226 to provide additional structural rigidity to the cover 32. Additionally, it is contemplated that one or more of the internal walls 230*a*-230*c* may be omitted for certain sections 194 of the cover 32 as described herein.

Figure 7:
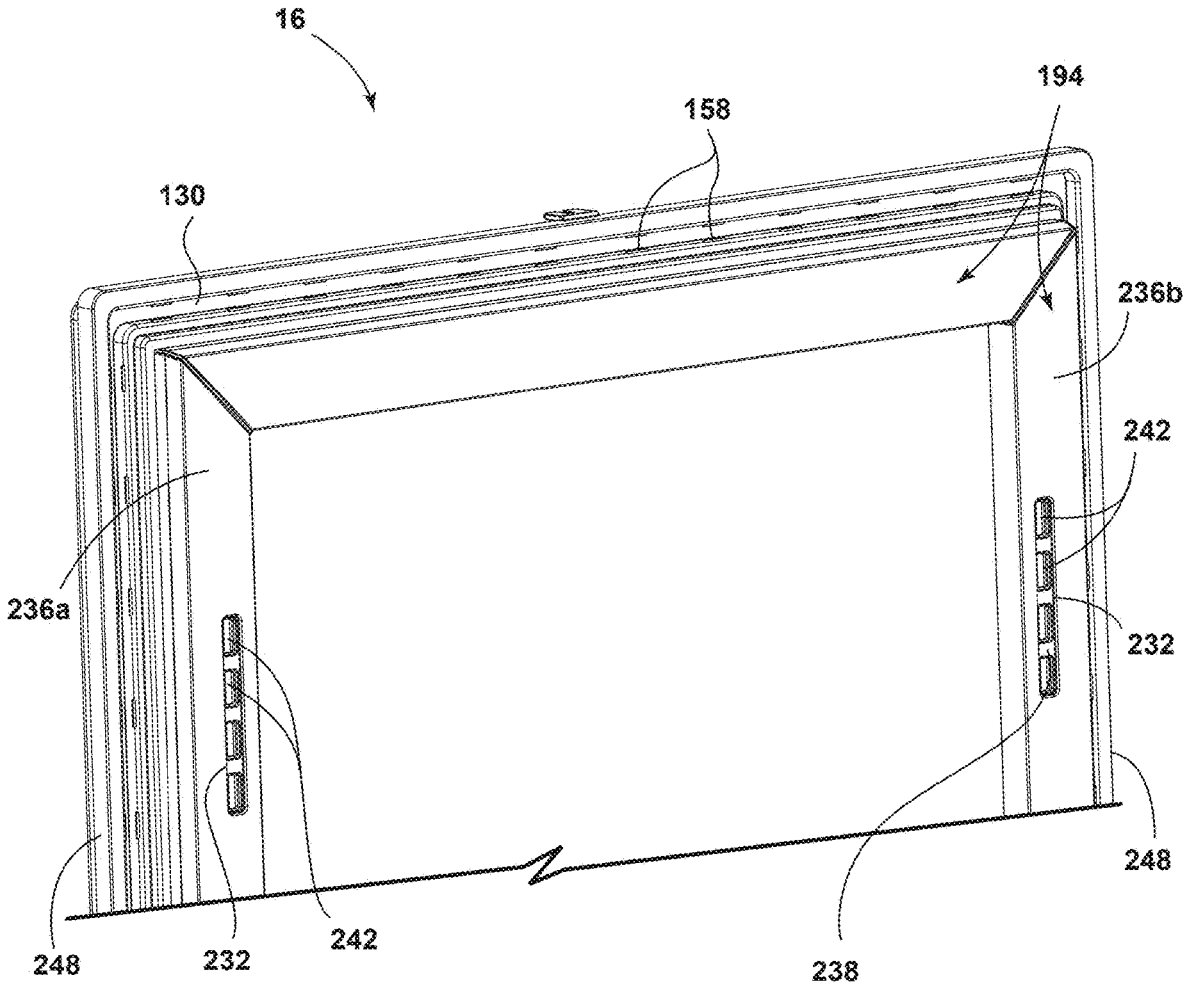
FIG. 7 is a partial side perspective view of a vacuum insulated door having a trim breaker and a cover, according to the present disclosure.
Figure 8:
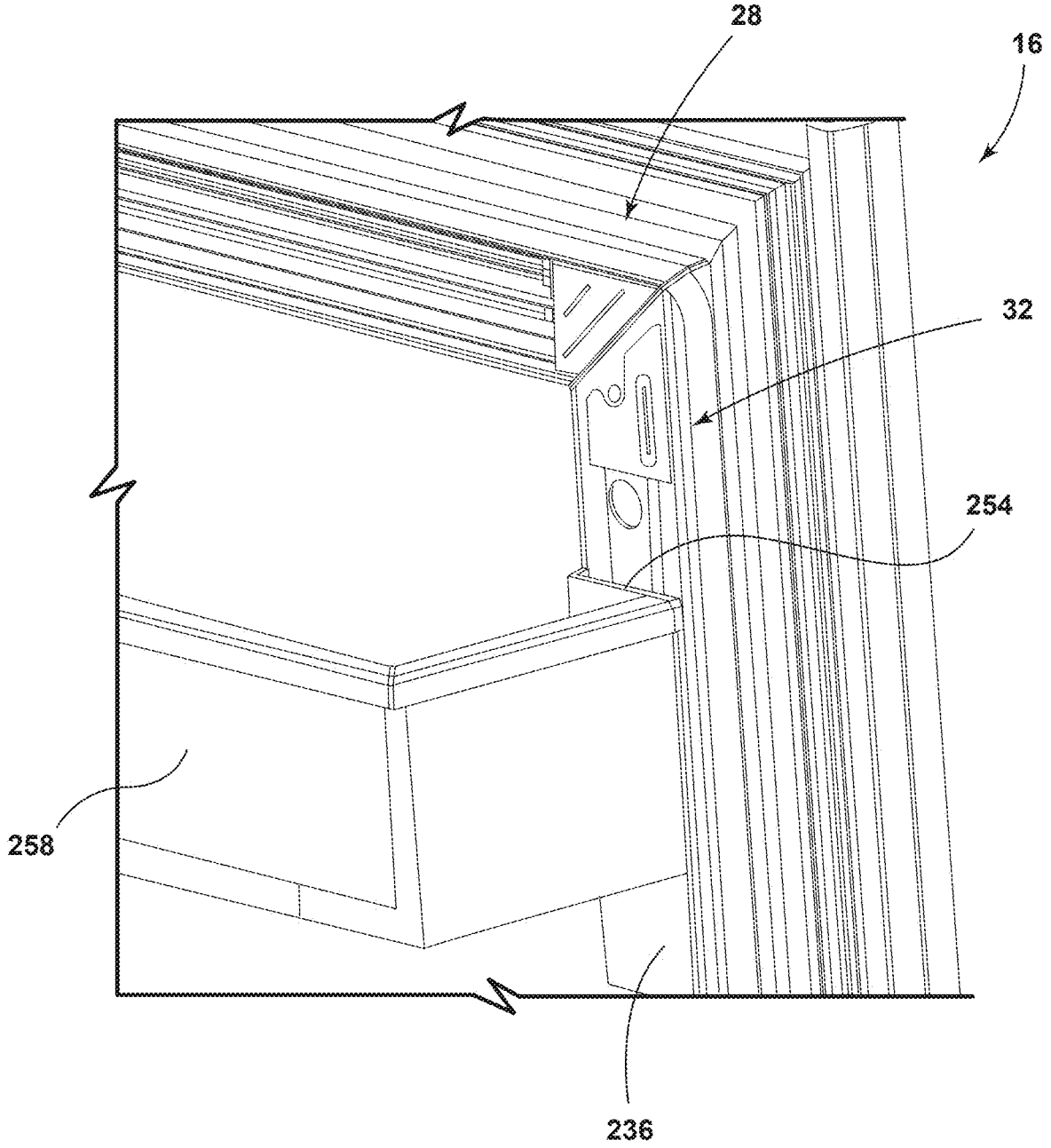
FIG. 8 is a partial side perspective view of a vacuum insulated door having a door shelf coupled to a ladder rack behind a cover, according to the present disclosure.

Referring to the illustrated configuration depicted in FIGS. 7 and 8, the cover 32 defines elongate openings 232 disposed along opposing vertical side sections 236*a*, 236*b* of the cover 32. The opposing vertical side sections 236*a*, 236*b* can be coupled to the door 16 without one or more of the internal walls 230*a*-230*c* of the cover 32, providing more space behind the cover 32 (i.e., between the cover 32 and the inner liner 18). In various examples, ladder racks 238 may be coupled with the inner liner 18. The ladder racks 238 can extend vertically and be used as support features. The ladder racks 238 may be positioned behind the opposing vertical side sections 236*a*, 236*b* of the cover 32 and coupled to the door 16 via welding or other similar fastening mechanisms, including those that maintain the at least partial vacuum within the door cavity 24. The ladder racks 238 may be positioned and extend parallel to the projection 26 along the sides of the door 16. Generally, the ladder racks 238 may be positioned on an inner side of the projection 26, proximate to the second wall 172.

The ladder racks 238 include a plurality of apertures 242. The elongate openings 232 may conceal portions of the ladder racks 238 while leaving some or all of the apertures 242 open, uncovered, or exposed. In other words, the elongate openings 232 may expose a first aperture 242 of the ladder racks 238 and the cover 32 may conceal a second aperture 242 of the ladder racks 238. The elongate openings 232 may be aligned with at least some of the plurality of apertures 242 of the ladder racks 238. Accordingly, the cover 32 may generally conceal the ladder racks 238 while allowing engagement with the apertures 242 for supporting a storage feature 258. In this regard, the plurality of apertures 242 are configured to receive opposing ends 254 of a door storage feature 258.

For example, as illustrated in FIG. 8, the opposing ends 254 each include at least one hook or protrusion that can engage or extend through one or more of the plurality of apertures 242 to assist in coupling the door storage feature 258 to the insulated door 16 in order to provide additional storage for the appliance 10. The door storage feature 258 may extend through the elongate openings 232 to engage the ladder racks 238. This configuration may be advantageous for concealing engagement portions between the storage feature 258 and the ladder racks 238. Further, when multiple apertures 242 are exposed by the elongate openings 232, the storage feature 258 may be moved to different heights by engaging different apertures 242. Traditionally, in more conventional arrangements, the door shelving of an appliance exposes components related to the attachment of the shelving to the door structure, including exposing the holes of support structures, however, the illustrated cover 32 assists in concealing the perimeter of the door 16 and the ladder racks 238 exposing the elongate openings 232 and the plurality of apertures 242.

Referring to FIGS. 1-8, the configuration of the projection 26 of the trim breaker 22 and the interface with the inner liner 18 of the door 16 and the cabinet 12 may be advantageous for minimizing the gap 182 between the door 16 and the cabinet 12. The elongated projection 26 of the trim breaker 22 extends towards and/or into the compartment 14, with the shortest distance 188 between the first wall 170 of the projection 26 and the cabinet 12 at approximately 6.2 mm. The reduction of the gap 182 to the shortest distance 188 helps reduce or prevent cold airflow from the compartment 14 from directly impacting the gasket 28 of the insulated door 16. Specifically, the reduction of the gap 182 through the extension of the projection 26 assists in minimizing cold air flow from the internal environment of the appliance 10 to reduce condensation build-up along the gasket 28, which can affect the seal of the door 16 over time. Additionally, the inclusion of the cover 32 over the projection 26 assists in further reducing the shortest distance 188 of the gap 182. Accordingly, the cover 32 may extend further than the engagement point between the gasket 28 and the cabinet 12 to further reduce the width of the gap 182.

The combination of the extension of the projection 26 and the cover 32 to minimize the gap 182 further assists in improving the energy efficiency of the appliance 10. By minimizing the amount of cold airflow that can escape the internal environment of the compartment 14, the dual-design of the projection 26 and cover 32 of the insulated door 16 can assist in retaining the desired or selected internal temperature of the appliance 10 and can reduce the cooling load on the appliance 10 system. Further, the heat generated by the conduit 72 assists in minimizing the condensation created from the cold airflow, while the dual-design of the projection 26 of the trim breaker 22 and the cover 32 can help break the conductive heat path created by the conduit 72, reducing or limiting the overall heat gain to the cooled compartment 14 of the appliance 10 and heat transfer to the trim breaker 22 and further enhancing the thermal efficiency of the appliance 10. The reduction of the shortest distance 188 of the gap 182 between the projection 26 of the trim breaker 22, the cover 32, and the cabinet 12 assists with maximizing the insulative performance of the vacuum insulated appliance 10, shielding the gasket 28 from condensation buildup while simultaneously reducing or limiting air exchange that may increase energy consumption.

Use of the present assembly may provide for a variety of advantages. For example, the extension of the projection 26 of the trim breaker 22 assists in minimizing the gap 182 defined between the cabinet 12 and the first wall 170 of the projection 26 of the trim breaker 22. The minimization of the gap 182 helps reduce cold airflow from the internal environment of the compartment 14 of the cabinet 12 that may lead to condensation buildup along the gasket 28 and compromising the seal created by the gasket 28 over time. Additionally, the addition of the cover 32 positioned over the projection 26 further minimizes the gap 182 assisting in the improvement of energy efficiency of the vacuum insulated appliance 10 by retaining the internal temperature and reducing the cooling load on the appliance 10 system. The dual-design of the projection 26 and the cover 32 also helps break the conductive heat path created by the conduit 72, limiting the overall heat gain to the compartment 14 and/or the door 16 and providing enhanced thermal efficiency of the appliance 10. Additionally, the configuration of the cover 32 assists in concealing the components utilized in coupling the door storage structure 258 to the door 16 by concealing the ladder racks 238 disposed along opposing vertical sides of the door 16. The cover 32 may also include interchangeable side sections 236 with various openings to access different apertures 242. This can increase flexibility in use and arrangement of the storage features 258. The configuration of the projection 26 of the trim breaker 22 and the cover 32 helps increase insulative performance of the vacuum insulated appliance 10 and simultaneously improving visual appeal. Additional benefits or advantages may be realized and/or achieved.

The device disclosed herein is further summarized in the following paragraphs and is further characterized by combinations of any and all various aspects described herein.

According to one aspect of the present disclosure, a vacuum insulated appliance includes a cabinet that defines a compartment. A vacuum insulated door is operably coupled with the cabinet, where the vacuum insulated door is operable between an opened position and a closed position. The vacuum insulated door includes an inner liner proximate the compartment when the vacuum insulated door is in the closed position. An outer wrapper is opposite the inner liner. A trim breaker is operably coupled to the inner liner and the outer wrapper to define a door cavity, where the trim breaker defines a projection extending toward the compartment when the vacuum insulated door is in the closed position. A gasket is coupled to the trim breaker and extends along a perimeter of the trim breaker, where the gasket abuts the cabinet when the vacuum insulated door is in the closed position. A cover is operably coupled to the vacuum insulated door and extends along a perimeter of the vacuum insulated door, where the cover is positioned over the projection.

According to another aspect, a cabinet includes a conduit through which refrigerant is configured to flow to heat a perimeter of the cabinet and reduce condensation development.

According to another aspect, a trim breaker includes a first groove and a second groove, the second groove defined by and positioned within the projection.

According to another aspect, an edge of an inner liner is disposed in a first groove and an edge of an outer wrapper is disposed in a second groove.

According to another aspect, a projection of a trim breaker includes a first wall and a second wall, the first wall opposite the second wall, and wherein a gap is defined between the first wall of the projection and a cabinet when a door is in a closed position to reduce airflow toward a gasket.

According to another aspect, a projection extends along a perimeter of a trim breaker proximate to a gasket.

According to another aspect, a cover includes opposing side sections that define elongate openings.

According to another aspect, ladder racks coupled with an inner liner and defining apertures, where the ladder racks are positioned behind the opposing side section of a cover, respectively, and wherein elongate openings are aligned with at least some of the apertures of the ladder racks.

According to another aspect, a storage feature having opposing ends defining at least one hook, where hooks are configured to extend through elongate openings of the opposing side sections of a cover to engage an aperture of ladder racks.

According to another aspect of the present disclosure, a refrigeration appliance includes a cabinet defining a compartment. A door assembly is operably coupled to the cabinet and is operable between an open position and a closed position. The door assembly includes an inner liner and an outer wrapper spaced apart from the inner liner to define a cavity. A trim breaker extends around a perimeter of the door assembly. The inner liner and outer wrapper are coupled to the trim breaker to close the cavity. A projection defined by the trim breaker and extending toward the compartment when the door assembly is in a closed position. A cover is operably coupled to the trim breaker and the inner liner of the door, where the cover is positioned over the projection of the trim breaker.

According to another aspect, a projection includes a first wall and a second wall, and where the projection minimizes a gap defined between the first wall of the projection and a cabinet when a door assembly is in a closed position.

According to another aspect, a projection extends at least to be aligned with an engagement point between a door and a gasket to minimize a size of a gap.

According to another aspect, a space is defined between a first wall of a projection and an inner surface of a cover, and where the cover further minimizes the size of a gap defined between a door assembly and a cabinet when the door assembly is in a closed position.

According to another aspect, a door assembly includes a gasket operably coupled to a trim breaker and abutting a cabinet when the door assembly is in a closed position, and where the gasket and a projection extend along a perimeter of the door assembly.

According to another aspect, a projection is elongated to extend further than an engagement point between a gasket and a cabinet to reduce a width of a gap when a door assembly is in a closed position.

According to another aspect, a cover extends further than an engagement point between a gasket and a cabinet to reduce a width of a gap when a door assembly is in a closed position.

According to yet another aspect of the present disclosure, an appliance includes a cabinet defining a compartment. A door assembly is operably coupled with the cabinet. The door assembly includes an inner liner and an outer wrapper opposite the inner liner. The inner liner and the outer wrapper define a vacuum insulated door cavity. A trim breaker is operably coupled to the inner liner and the outer wrapper, where the trim breaker defines a projection having a first wall and a second wall and extending outward from the inner liner and around a perimeter of the trim breaker. A cover is operably coupled to the trim breaker and the inner liner. The cover extends around the perimeter of the trim breaker, where the cover is positioned over the projection.

According to another aspect, a gap is defined between a projection and a cabinet when a door is in a closed position, and where a cover minimizes the gap to reduce airflow from an internal environment of the compartment to the gasket.

According to another aspect, a cover includes a first portion extending from a ledge of a trim breaker between a gasket and a first wall of a projection of a door assembly.

According to another aspect, a cover includes a second portion including an internal projection engaging with an end of a projection and a third portion having an internal wall that extends along an inner liner.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A vacuum insulated appliance, comprising:

a cabinet defining a compartment; and a vacuum insulated door operably coupled with the cabinet, wherein the vacuum insulated door is operable between an opened position and a closed position, the vacuum insulated door including:

an inner liner proximate the compartment when the vacuum insulated door is in the closed position;

an outer wrapper opposite the inner liner;

a trim breaker operably coupled to the inner liner and the outer wrapper to define a door cavity, wherein the trim breaker defines a projection extending toward the compartment when the vacuum insulated door is in the closed position;

a gasket coupled to the trim breaker and extending along a perimeter of the trim breaker, wherein the gasket abuts the cabinet when the vacuum insulated door is in the closed position;

a cover operably coupled to the vacuum insulated door and extending along a perimeter of the vacuum insulated door, wherein the cover is positioned over the projection, wherein the cover defines elongate openings; and ladder racks operably coupled to the inner liner and defining apertures, wherein the ladder racks are positioned behind the cover, and wherein the elongate openings of the cover expose a first portion of the ladder racks and the cover conceals a second portion of the ladder racks.

2. The vacuum insulated appliance of claim 1, wherein the cabinet includes a conduit through which refrigerant is configured to flow to heat a perimeter of the cabinet and reduce condensation development.

3. The vacuum insulated appliance of claim 1, wherein the trim breaker includes a first groove and a second groove, the second groove defined by and positioned within the projection.

4. The vacuum insulated appliance of claim 3, wherein an edge of the inner liner is disposed in the first groove and an edge of the outer wrapper is disposed in the second groove.

5. The vacuum insulated appliance of claim 1, wherein the projection of the trim breaker includes a first wall and a second wall, the first wall opposite the second wall, and wherein a gap is defined between the first wall of the projection and the cabinet when the vacuum insulated door is in the closed position to reduce airflow toward the gasket.

6. The vacuum insulated appliance of claim 1, wherein the projection extends along the perimeter of the trim breaker proximate to the gasket.

7. The vacuum insulated appliance of claim 1, wherein the cover includes opposing side sections that define the elongate openings.

8. The vacuum insulated appliance of claim 7, wherein the ladder racks are positioned behind the opposing side sections of the cover, respectively, and wherein the elongate openings are aligned with at least some of the apertures of the ladder racks.

9. The vacuum insulated appliance of claim 8, wherein the vacuum insulated door includes:

a storage feature having opposing ends defining at least one hook, and wherein hooks are configured to extend through the elongate openings of the opposing side sections of the cover to engage the apertures of the ladder racks.

10. A refrigeration appliance, comprising:

a cabinet defining a compartment; and a door assembly operably coupled to the cabinet and operable between an opened position and a closed position, the door assembly including:

an inner liner;

an outer wrapper spaced apart from the inner liner to define a cavity;

a trim breaker extending around a perimeter of the door assembly, the inner liner and outer wrapper coupled to the trim breaker to close the cavity;

a projection defined by the trim breaker and extending toward the compartment when the door assembly is in the closed position;

a cover operably coupled to the trim breaker and the inner liner of the door assembly, wherein the cover is positioned over the projection of the trim breaker, and wherein the cover defines elongate openings; and a ladder rack coupled to the inner liner and positioned behind the cover, wherein the ladder rack defines a plurality of apertures, and wherein the elongate openings of the cover align with at least some of the plurality of apertures, and further wherein the cover conceals a portion of the ladder rack.

11. The refrigeration appliance of claim 10, wherein the projection includes a first wall and a second wall, and wherein the projection minimizes a gap defined between the first wall of the projection and the cabinet when the door assembly is in the closed position.

12. The refrigeration appliance of claim 11, wherein the projection extends at least to be aligned with an engagement point between the door assembly and a gasket to minimize a size of the gap.

13. The refrigeration appliance of claim 11, wherein a space is defined between the first wall of the projection and an inner surface of the cover, and wherein the cover further minimizes a size of the gap defined between the door assembly and the cabinet when the door assembly is in the closed position.

14. The refrigeration appliance of claim 12, wherein the door assembly includes the gasket operably coupled to the trim breaker and abutting the cabinet when the door assembly is in the closed position, and wherein the gasket and the projection extend along the perimeter of the door assembly.

15. The refrigeration appliance of claim 14, wherein the projection is elongated to extend further than an engagement point between the gasket and the cabinet to reduce a width of the gap when the door assembly is in the closed position.

16. The refrigeration appliance of claim 14, wherein the cover extends further than an engagement point between the gasket and the cabinet to reduce a width of the gap when the door assembly is in the closed position.

17. An appliance, comprising:

a cabinet defining a compartment; and a door assembly operably coupled with the cabinet, the door assembly including:

an inner liner;

an outer wrapper opposite the inner liner, wherein the inner liner and the outer wrapper define a vacuum insulated door cavity;

a trim breaker operably coupled to the inner liner and the outer wrapper, wherein the trim breaker defines a projection having a first wall and a second wall, the projection extending outward from the inner liner and around a perimeter of the trim breaker;

a cover operably coupled to the trim breaker and the inner liner, the cover extending around the perimeter of the trim breaker, wherein the cover is positioned over the projection, wherein a portion of the cover defines elongate openings; and ladder racks operably coupled to the inner liner and defining apertures, and wherein the elongate openings expose a first aperture of the ladder racks and the cover conceals a second aperture of the ladder racks.

18. The appliance of claim 17, wherein a gap is defined between the projection and the cabinet when the door assembly is in a closed position, and wherein the cover minimizes the gap to reduce airflow from an internal environment of the compartment to a gasket.

19. The appliance of claim 18, wherein the cover includes a first portion extending from a ledge of the trim breaker between the gasket and the first wall of the projection of the door assembly.

20. The appliance of claim 19, wherein the cover includes a second portion including an internal projection engaging with an end of the projection and a third portion having an internal wall that extends along the inner liner.

* * * * *